US010376947B2

(12) United States Patent
Koli et al.

(10) Patent No.: US 10,376,947 B2
(45) Date of Patent: Aug. 13, 2019

(54) MULTIPLE WIRE WRAP SCREEN FABRICATION METHOD

(71) Applicant: BAKER HUGES, A GE COMPANY, LLC, Houston, TX (US)

(72) Inventors: Jai K. Koli, Houston, TX (US); Syed Mohamed Mohammed Hussain, Dharmapuri (IN)

(73) Assignee: BAKER HUGES, A GE COMPANY, LLC, Houston, TX (US)

( * ) Notice: Subject to any disclaimer, the term of this patent is extended or adjusted under 35 U.S.C. 154(b) by 870 days.

(21) Appl. No.: 14/586,421

(22) Filed: Dec. 30, 2014

(65) Prior Publication Data

US 2016/0184880 A1 Jun. 30, 2016

(51) Int. Cl.

| | |
|---|---|
| ***B21F 15/00*** | (2006.01) |
| ***B21F 27/12*** | (2006.01) |
| ***B21F 3/04*** | (2006.01) |
| ***E21B 43/08*** | (2006.01) |

(52) U.S. Cl.

CPC ..... *B21F 15/00* (2013.01); *B21F 27/124* (2013.01); *E21B 43/088* (2013.01); *B21F 3/04* (2013.01)

(58) Field of Classification Search

CPC .... B21F 3/04; B21F 3/08; B21F 31/00; B21F 15/00; B21F 15/06; B21F 15/08; B21F 27/124; E21B 43/088

See application file for complete search history.

(56) References Cited

U.S. PATENT DOCUMENTS

| | | | | |
|---|---|---|---|---|
| 4,494,603 | A * | 1/1985 | Harguindey | B01D 29/111 166/230 |
| 5,190,102 | A * | 3/1993 | Arterbury | B01D 29/111 166/228 |
| 6,125,932 | A | 10/2000 | Hamid et al. | |
| 6,742,586 | B2 | 6/2004 | Lauritzen et al. | |
| 7,188,687 | B2 | 3/2007 | Rudd et al. | |
| 7,273,106 | B2 | 9/2007 | Huckabee et al. | |
| 8,096,037 | B2 | 1/2012 | Ferguson et al. | |
| 8,267,169 | B2 | 9/2012 | Moen et al. | |
| 8,291,971 | B2 | 10/2012 | Lopez et al. | |
| 8,602,096 | B2 * | 12/2013 | Olenick | E21B 43/086 166/233 |
| 8,701,757 | B2 | 4/2014 | Greci | |
| 2005/0082060 | A1 | 4/2005 | Ward et al. | |
| 2005/0125980 | A1 | 6/2005 | Rakow, Jr. et al. | |

(Continued)

FOREIGN PATENT DOCUMENTS

WO 2010143060 A1 12/2010

*Primary Examiner* — Christopher J Besler
(74) *Attorney, Agent, or Firm* — Shawn Hunter

(57) ABSTRACT

A wire wrap screen manufacturing method for a given screen diameter involves simultaneous winding of parallel wires that begin in circumferentially offset locations on one end of a perforated base pipe that has circumferentially spaced support rods saves fabrication time. Each of the ends of the wires lie in a common plane to allow fitting an end cap for sealing or to just continuously weld at the ends of the wires to seal the assembly to the base pipe. The spot welds to the support rods occur as the wire is wound over such rods. Equal initial circumferential spacing of the start locations for the wires is preferred although asymmetrical spacing is preferred.

13 Claims, 2 Drawing Sheets

(56) References Cited

U.S. PATENT DOCUMENTS

| | | | | |
|---|---|---|---|---|
| 2009/0133874 | A1* | 5/2009 | Dale | E21B 43/088 166/278 |
| 2009/0283271 | A1 | 11/2009 | Langeslag | |
| 2010/0224359 | A1 | 9/2010 | Kim et al. | |
| 2010/0259300 | A1 | 10/2010 | Aziz et al. | |
| 2013/0062269 | A1 | 3/2013 | Hagen et al. | |
| 2013/0092391 | A1 | 4/2013 | Greene et al. | |
| 2014/0158295 | A1 | 6/2014 | Badrak | |

* cited by examiner

MULTIPLE WIRE WRAP SCREEN FABRICATION METHOD

FIELD OF THE INVENTION

The field of the invention is a fabrication method for a wire wrap screen and more particularly a method to speed up fabrication time by winding and welding multiple adjacent wires at the same time.

BACKGROUND OF THE INVENTION

Wire wrap screens comprise a perforated base pipe having a plurality of spaced axially oriented rods over which a wire generally having a trapezoidal cross section is wrapped continuously and spot welded to the rods as the winding process continues. Fairly sophisticated machines such as illustrated in FIG. 2 of US 2005/0125980 are used to wrap the single wire around the axially oriented rods to make a screen that is of a particular diameter. As is also illustrated in FIG. 5 of this reference, nested wire wrap screens of different dimensions can be produced at the same time with a single wire feed going on at the same time for constructing the screens that have different outside diameters. Even when building nested screens at the same time, each screen is assembled with a single wire feed. This is a rather slow process that could require as much as 90 minutes for the fabrication of 20 feet of screen. The fabrication process involves feeding wire on a rotating hub of a base pipe with spaced axially oriented rods and spot welding the wire to the rods periodically to maintain the wire spacing on the wraps. It is the wire spacing that determines the particle size that will be retained on the wires when the finished screen is in use.

Other techniques called pre-pack put a filtering layer under the wire wrap as illustrated in U.S. Pat. No. 5,190,102. Other manufacturing techniques for wire wrap screens involve the use of expansion to assemble the wrapped wire and base pipe together as illustrated in U.S. Pat. No. 8,096,037.

What is needed and provided by the present invention is a production method for wire wrap screens that increases the manufacturing speed of such screens. This is accomplished with a feeding technique that feeds multiple wires that begin at circumferentially spaced locations so that for every revolution of the rotating hub assembly multiple windings of wire are applied and spot welded or otherwise attached. At the opposite end of the screen the individual wires are terminated at circumferentially offset locations similar to the initial end of the manufactured screen so that the ends may be transverse to the longitudinal axis to permit end sealing with caps to be welded or simply by welding the ends to the base pipe and rods that underlie the wire wrapping. These and other aspects of the present invention will be more readily apparent to those skilled in the art from a review of the detailed description of the preferred embodiment and the associated drawings while recognizing that the full scope of the invention is to be determined from the appended claims.

SUMMARY OF THE INVENTION

A wire wrap screen manufacturing method for a given screen diameter involves simultaneous winding of parallel wires that begin in circumferentially offset locations on one end of a perforated base pipe that has circumferentially spaced support rods saves fabrication time. Each of the ends of the wires lie in a common plane to allow fitting an end cap for sealing or to just continuously weld at the ends of the wires to seal the assembly to the base pipe. The spot welds to the support rods occur as the wire is wound over such rods. Equal initial circumferential spacing of the start locations for the wires is preferred although asymmetrical spacing is preferred.

DETAILED DESCRIPTION OF THE PREFERRED EMBODIMENT

Figure 1:
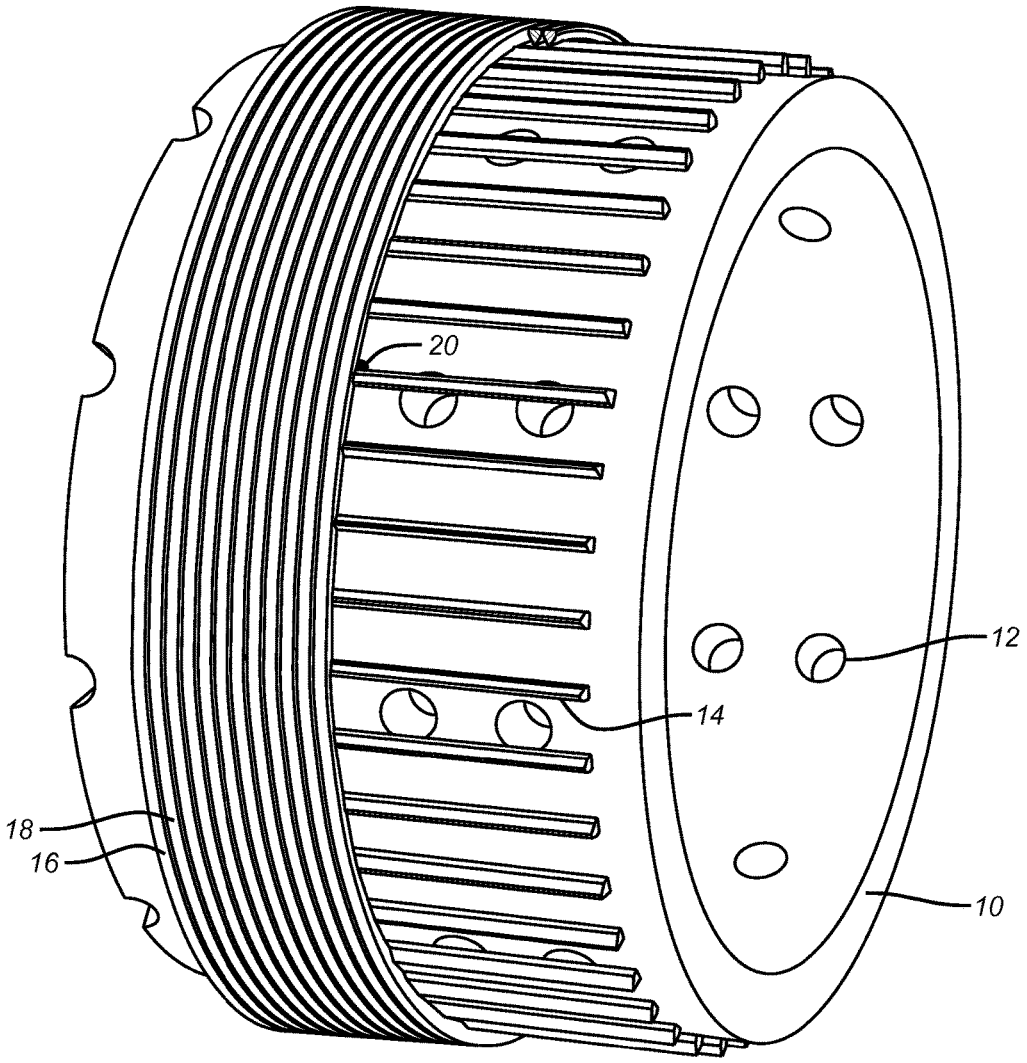
FIG. 1 is a perspective view of two wires being wrapped at the same time with the screen partially built.
Figure 2:
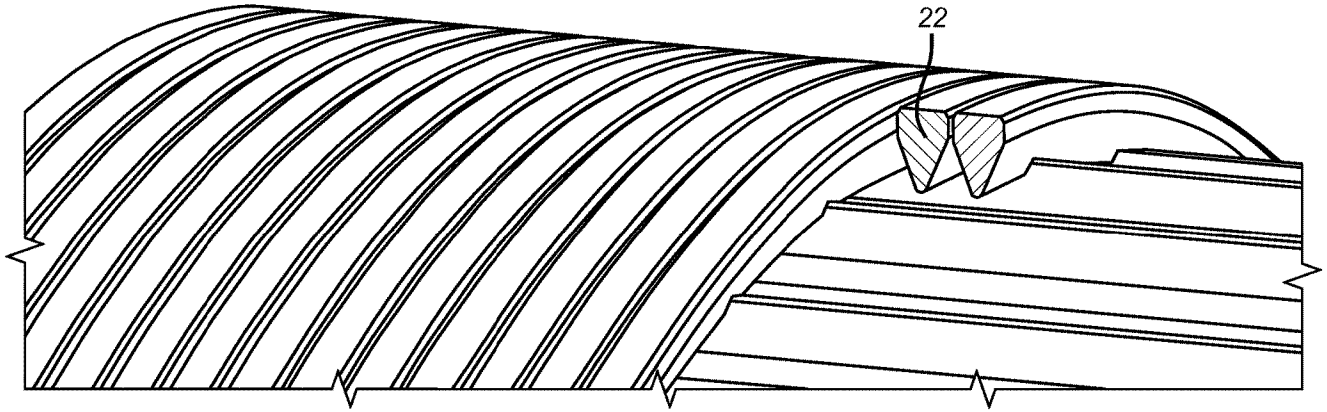
FIG. 2 is a close up view of the ends of the two wires being wound at the same time.
Figure 3:
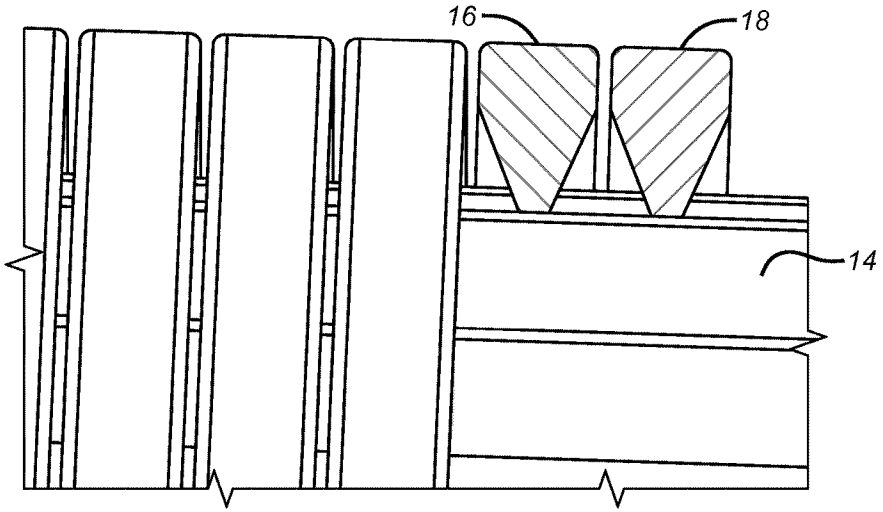
FIG. 3 is a side view of the wires being wound at the same time.

Referring to FIG. 1 a base pipe 10 has a series of openings 12. Support rods 14 extend axially and are shown at regular circumferentially spaced intervals with some of the rods 14 over the openings 12 and some avoiding the openings 12. The openings 12 can be in rows as shown or randomly distributed to get the desired amount of open area for the anticipated flow through the screen at a desired pressure drop. The spacing of the rods 14 can also be variable in a circumferential direction but it is preferred that their orientation be aligned with a longitudinal axis of the base pipe 10. Some angular variation from parallel to the base pipe 10 longitudinal axis is tolerable within about plus or minus 5 degrees.

The method comprises of winding multiple wires such as 16 and 18 at the same time with the desired spacing between them to define the size of the solids that are to be retained on the outside of the assembled screen. Instead of feeding a single wire onto a base pipe with rods 14 as in the past the present method takes multiple adjacent wires 16 and 18 and feeds them with a common pitch to maintain a constant spacing as the base pipe is rotated. As each wire crosses a support rod 14 a spot weld 20 can be initiated. The orientation is such that both wires such as 16 & 18 can be spot welded to a given support rod 14 at a time. Although two wires that are run adjacent to each other are illustrated, depending on the wire feeder design possibly more adjacent wires can be wound at the same time within the scope of the invention. Preferably the start of each wire is circumferentially offset from other wires being wound but starts in the same transverse plane perpendicular to the longitudinal axis of the base pipe 10. Because of this an end cap (not shown) can be mounted to each end of the wire wrap to seal the end of the shape made by the wound wires to the base pipe or alternatively the end of the wires can be otherwise sealed to the base pipe 10 with continuous welding or by other means. The attachment of the wires to the rods 14 can be with resistance welding. The preferred wire cross-sectional shape is trapezoidal although other shapes such as round or quadrilateral are contemplated. The start locations and end locations of each of the multiple wires being run adjacent to each other at the same time is preferably even spaced circumferentially although other uneven spaces are contemplated. The multiple wires can be fed in the same plane and as contact is made with each successive wire 14 a resistance weld is formed.

The advantage of the method is shortening the time for fabrication of the same length of screen by a factor of how many wires are being fed at the same time.

The above description is illustrative of the preferred embodiment and many modifications may be made by those skilled in the art without departing from the invention whose scope is to be determined from the literal and equivalent scope of the claims below:

We claim:

1. A wire wrap screen fabrication method, comprising:

providing a base pipe having a single diameter with generally axially extending exterior support rods;

winding multiple axially spaced discrete wires onto said rods at the same time with a gap defined by a spacing between each adjacent wire of the multiple axially spaced discrete wires, and wherein none of the multiple axially spaced discrete wires abuts another of the multiple axially spaced discrete wires, the gap representing an opening size for retention of particles from passing into said base pipe; and maintaining a constant separation between said multiple axially spaced discrete wires during the winding.

2. The method of claim 1, comprising:

starting said multiple axially spaced discrete wires at circumferentially spaced locations on said base pipe.

3. The method of claim 1, comprising:

sealing ends formed by said multiple axially spaced discrete wires to said base pipe.

4. The method of claim 1, comprising:

using welding to seal ends formed by said multiple axially spaced discrete wires to said base pipe.

5. The method of claim 4, comprising:

mounting a ring to each opposed end formed by said wires;

welding said rings to said base pipe.

6. The method of claim 1, comprising:

resistance welding said multiple axially spaced discrete wires to said exterior support rods.

7. The method of claim 1, comprising:

using a trapezoidal cross section for said wires.

8. The method of claim 1, comprising:

using a round or quadrilateral cross section for said multiple axially spaced discrete wires.

9. The method of claim 1, comprising:

sealing ends formed by said multiple axially spaced discrete wires to said base pipe.

10. The method of claim 9, comprising:

using welding to seal ends formed by said multiple axially spaced discrete wires to said base pipe.

11. The method of claim 10, comprising:

mounting a ring to each of the ends formed by said multiple axially spaced discrete wires;

welding said rings to said base pipe.

12. The method of claim 11, comprising:

resistance welding said multiple axially spaced discrete wires to said exterior support rods.

13. The method of claim 12, comprising:

using a trapezoidal cross section for said wires.

* * * * *